United States Patent [19]

McNeil

[11] Patent Number: 4,687,153

[45] Date of Patent: Aug. 18, 1987

[54] ADJUSTABLE SHEET LENGTH/ADJUSTABLE SHEET COUNT PAPER REWINDER

[75] Inventor: Kevin B. McNeil, Maineville, Ohio

[73] Assignee: The Procter & Gamble Company, Cincinnati, Ohio

[21] Appl. No.: 746,154

[22] Filed: Jun. 18, 1985

[51] Int. Cl.[4] ..... B65H 16/10; B65H 35/10

[52] U.S. Cl. ..... 242/56.8; 83/341; 83/342; 83/658

[58] Field of Search ..... 242/56.8; 83/342, 346, 83/349, 658, 660, 331, 341

[56] References Cited

U.S. PATENT DOCUMENTS

| | | | |
|---|---|---|---|
| 2,266,995 | 12/1941 | Schultz et al. | 242/56.8 X |
| 3,056,323 | 10/1962 | Kwitek | 83/342 |
| 3,190,163 | 6/1965 | Bradley | 83/342 |
| 3,782,650 | 1/1974 | Donnell | 242/56.8 |

FOREIGN PATENT DOCUMENTS

| | | | |
|---|---|---|---|
| 2105687 | 3/1983 | United Kingdom | 242/56.8 |

*Primary Examiner*—Stuart S. Levy
*Assistant Examiner*—Joseph J. Hail, III
*Attorney, Agent, or Firm*—Thomas J. Slone; Frederick H. Braun; Richard C. Witte

[57] ABSTRACT

An improvement in paper converting rewinders in which bulk rolls of paper are converted into consumer product rolls of paper such as tear-separable multi-sheet rolls of toilet tissue or paper towels. In such rewinders of the type which include a perforator cylinder, and a bedroll/chop-off roll combination, changes in sheet length and/or sheet count commonly require changing one or more of such rotating, paper contacting machine elements. The present invention enables broad changes in both sheet length and sheet count in such rewinders without changing either the perforator cylinder or the bedroll or the chop-off roll. The invention also enables adjustments to assure true cross machine direction orientation of inter-sheet lines of perforation throughout the range of adjusting sheet length and/or sheet count per product roll.

4 Claims, 4 Drawing Figures

ADJUSTABLE SHEET LENGTH/ADJUSTABLE SHEET COUNT PAPER REWINDER

DESCRIPTION

1. Technical Field

The invention pertains to apparatus—commonly called rewinders—for unwinding one or more parent rolls of paper and rewinding the paper onto cores to produce consumer rolls of paper products: for example, rolls of paper towels, or rolls of toilet paper. More specifically it pertains to providing such a rewinder in which sheet length and sheet count per roll can be changed.

2. Background

Rewinders for paper—apparatus for unwinding parent rolls of paper and rewinding them into consumer product rolls having multiple tear-apart sheets (eg., toilet paper or paper towels)—of the type which include a fixed pitch perforating cylinder for perforating the paper at sheet length intervals to provide tear apart convenience, and a fixed pitch bedroll/chop-off roll combination for separating roll lengths of paper, and which operate such cylinders and rolls in surface speed matched timed relation with advancing the paper have a number of shortcomings.

First, the perforating cylinder has a circumference which is somewhat (eg., about two (2) or three (3) percent) greater than an integer number of sheet lengths, and are fitted with heat integer number of cross machine oriented perforating blades which are evently circumferentially spaced: i.e., fixed pitch. The paper is forwarded under sufficient tension when perforated that when subsequently relaxed (i.e., tension removed), the desired sheet length is achieved. Such prior art apparatuses have, of course, means for controlling draw in the paper to compensate for differences which would otherwise precipitate relaxed sheet length differences using a fixed pitch perforating cylinder. Inasmuch as changes in draw normally result in changes in the machine direction tension applied to the paper, greater tension may be applied than is required for paper control. Such greater tension generally pulls more crepe out of creped paper than is desired for paper product performance, and necessitates providing greater bond strength across the lines of perforation than would otherwise be required. Such lines of perforation having greater strength than otherwise required are, of course, harder for the ultimate user to tear apart and thus as a negative attribute. Also, to provide a desired degree of crepe in the finished product, the paper may have to be over-creped on the papermaking machine, and this has a negative impact on the production capacity of the papermaking machine as well as the production cost for the paper. Alternatively, constant tension or draw may be maintained in the rewinder with resultant relaxed sheet length variability which is a consumer negative; and requires oversizing some sheets to insure that none are undersized which might otherwise precipitate fair packaging regulation infractions.

Second, the bedroll is commonly sized to have a circumference equal to an integer number of nominally tensioned sheet lengths: eg., four. Thus, changes of sheet count per roll are normally one or more times that integer: i.e., one times four; two times four, etc. Such bulk changes in sheet count are of course negative restraints on manufacturing/product definition.

The improved rewinder provided by the present invention enables, without requiring machine cylinder or roll changes: adjustable sheet length at low tension/-draw; changing sheet counts per product roll by one sheet increment; and ensures that roll ends coincide with sheet ends. This results, of course, in such benefits as reduced costs (i.e., not having to buy new cylinders and/or anvils and/or rolls), less downtime, and more manufacturing flexibility with respect to product configuration changes.

DISCLOSURE OF THE INVENTION

The invention provides improved paper rewinders of the type which include means such as a perforator cylinder and compatible anvil for perforating a running paper web at sheet length intervals to provide tear-apart convenience; means such as a bedroll and compatible chop-off roll for breaking or otherwise parting the running paper web at product roll length intervals; and means such as a multi-mandrel turret assembly for winding each product roll length of the paper onto, for example, a disposable core to make such rolled paper products as toilet paper and disposable paper towels. In accordance with one aspect of the present invention, such an improved paper rewinder for converting parent rolls of paper into multi-separable-sheet product rolls is provided which comprises means for adjusting sheet length and sheet count without changing rolls or cylinders in the rewinder.

The improved rewinder also preferably includes means for assuring an integer sheet count of whole sheets per product roll by providing dynamic (i.e., adjustable while the rewinder is running) phase adjusting means disposed between means such as a perforator cylinder (for perforating the paper at sheet length intervals to provide tear apart convenience), and means for breaking or otherwise parting the paper at product roll length intervals so that each product roll end is coincident with a line of perforations intermediate adjacent sheets. The means for adjusting sheet length may comprise means for rotating a perforator cylinder at a different circumferential surface velocity that the paper is being forwarded through the rewinder; and the means for effecting sheet count per product roll changes comprises means for adjusting the drive ratio between a perforator cylinder and roll end means which means may be a paired combination of a bedroll and a chopper roll as described herein.

In an aspect of the invention which pertains to a rewinder wherein the perforating means comprises a fixed pitch perforator cylinder having true cross machine direction oriented perforating blades, and a fixed-pitch-helix, stationary anvil, the improvement further comprises means for associating and moving, said anvil and said perforator cylinder so that they can jointly be skewed with respect to the paper being forwarded through the rewinder to assure true cross machine direction orientation of the lines of perforation regardless of whether the surface velocity of the perforator cylinder and the paper velocity are matched or unequal. The improved rewinders may also include means for adjusting the draw imparted to the paper as it courses through the rewinder: preferably means which are independent from the sheet length and sheet count elements, and which enable independently adjusting such draw in the several free spans of the paper path.

BRIEF DESCRIPTIONS OF THE DRAWINGS

While the specification concludes with claims which particularly point out and distinctly claim the subject matter regarded as forming the present invention, it is believed the invention will be better understood from the following description taken in conjunction with the accompanying drawings in which identical features in the several views are identically designated and in which:

DETAILED DESCRIPTION OF THE INVENTION

Figure 1:
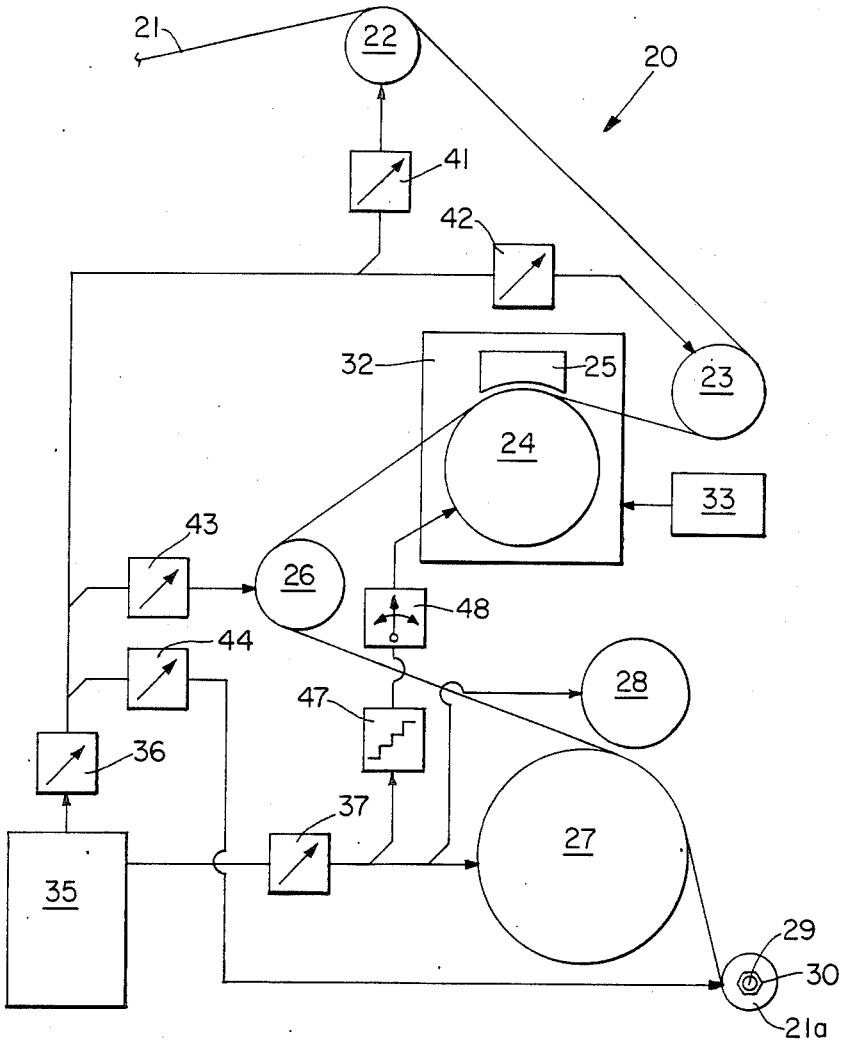
FIG. 1 is fragmentary, somewhat schematic side elevational view of an improved paper rewinder which is an embodiment of the present invention.

A fragmentary portion of an exemplary paper rewinder 20 embodiment of the invention for rewinding paper 21 is shown in FIG. 1 to comprise paper drive components which include a Mount Hope Roll 22, feed roll 23, slitter roll 26, and one of plural rewind mandrels 29 which are disposed on an indexing turret; sheet length and sheet count components which include a perforator cylinder 24 that coacts with stationary anvil 25, bedroll 27, and chopper roll 28; drive and master speed control 35, speed adjuster 36 for the paper drive components, speed adjuster 37 for the sheet length and count components, fine speed adjusters 41 through 44 for independently adjusting the draw between various driven paper drive components, stepwise speed adjuster 47 disposed intermediate perforator cylinder 24 and bedroll 27, and a phase adjuster 48 which enables circumferentially indexing the perforator cylinder 24 with the bedroll 27 so that the bedroll 27 and the chopper roll 28 always coact to break or otherwise part the paper 21 along a line of perforations imposed by the perforator cylinder 24 to define the end of each roll of paper being wound onto cores 30 on mandrels 29. Additionally, FIG. 1 shows perforator cylinder 24 and anvil 25 mounted on a sub-frame 32, and means 33 for skewing sub-frame 32 with respect to the path of paper 21 for a purpose described below.

Briefly, as compared to unimproved rewinders of the general type shown and described herein—for example Model 150 made by Paper Converting Machine Co.—the improved rewinder provided by the present invention enables adjusting sheet length and sheet count in rolled paper products produced thereon without having to change either the perforator cylinder, the anvil, the bedroll, or the chopper roll. Essentially this is enabled by substantially reducing the extent the paper wraps the perforator cylinder and the bedroll; and by providing independent speed (i.e., surface velocity) control means for the paper drive components as compared to the sheet length and count components as identified above. For example in an unmodified PCMC Series 150 rewinder, the paper path wraps about two-hundred-twenty-five (225) degrees of the perforator cylinder 24, and about ninety (90) degrees of bedroll 27; and, in those modified in accordance with the present invention, the wraps are about fifty-five (55) and fifty (50) degrees, respectively. The substantially reduced wraps enable the paper web to slip with respect to the perforator cylinder and the bedroll without undue friction or loss of web control which might otherwise break the paper web coursing through the rewinder. Accordingly, sheet length can be increased or decreased by speeding up or slowing down, respectively, the paper relative to the surface velocity of the perforator cylinder; and sheet count per finished product roll can be adjusted by changing a pair of gears drivingly disposed intermediate the bedroll and the perforator cylinder as described below. Additionally, inasmuch as such prior art rewinders commonly have a fixed pitch helical anvil configuration which coacts with true cross machine direction oriented perforating blades disposed at fixed pitch intervals on the perforator cylinder to avoid making entire lines of perforations at the same time as would occur with a single cross machine direction oriented anvil, such prior art rewinders require the paper velocity to be equal to the surface velocity of the perforator cylinder in order to achieve true cross machine direction oriented lines of perforation. The means for skewing the anvil and perforator cylinder in the improved rewinder of the present invention by skewing their sub-frame 32 relative to the paper path enables such fixed pitch elements to precipitate true cross machine direction oriented lines of perforation at velocity mismatched conditions; i.e., when the paper web is being forwarded at a greater or lesser velocity than the surface velocity of the perforator cylinder for sheet length control purposes.

Sheet length adjustability provided by the present invention may be most clearly understood by first considering a rewinder having a fixed pitch perforator cylinder, and which is being operated to a steady state condition with the paper velocity equal to the surface velocity of the perforator cylinder; and by then introducing the changes required to effect sheet length changes.

For example, a perforator cylinder having perforator blades disposed at one-hundred-twenty (120) degree intervals, and sized to provide sheets having relaxed lengths of ten (10) inches (25.4 cm.) by perforating a running web of paper under a draw of one (1) percent would have a circumference of about thirty-and-three-tenths (30.3) inches (about 77 cm.). In order to shorten the sheets to nine (9) inches (22.86 cm.), the circumferential velocity of the perforator cylinder is increased by ten (10) percent relative to the velociy of the paper. This can be achieved by increasing the velocity of the perforator cylinder per se through adjuster 37 (eg., a variable pitch sheave), or decreasing the paper velocity by adjuster 36. Opposite changes may similarly be made to increase sheet lengths. Concurrently, of course, any change made in the relative velocity between the paper and the perforator cylinder requires adjustment of the skew of the sub-frame 32 by skew adjuster 33 to insure that the lines of perforation which separate the sheets are oriented in the true cross machine direction of the paper as described above. By thus effecting sheet length changes by independently controlling the paper velocity and the perforator cylinder velocity, and by using the skew adjust to maintain true cross machine direction orientation of the lines of perforation, the former need to replace the perforator cylinder with a larger or smaller diameter cylinder, and the helical anvil to one which is sized to match the perforator cylinder's increased or decreased diameter to effect sheet length changes is obviated by the present invention.

Parenthetically, this also enables the rewinder to rewind papers having different draw/relaxation properties by first adjusting the draw elements to effect the degree of draw required for sheet control, and then adjusting the paper vs perforator velocity to achieve the desired relaxed sheet lengths.

Figure 2:
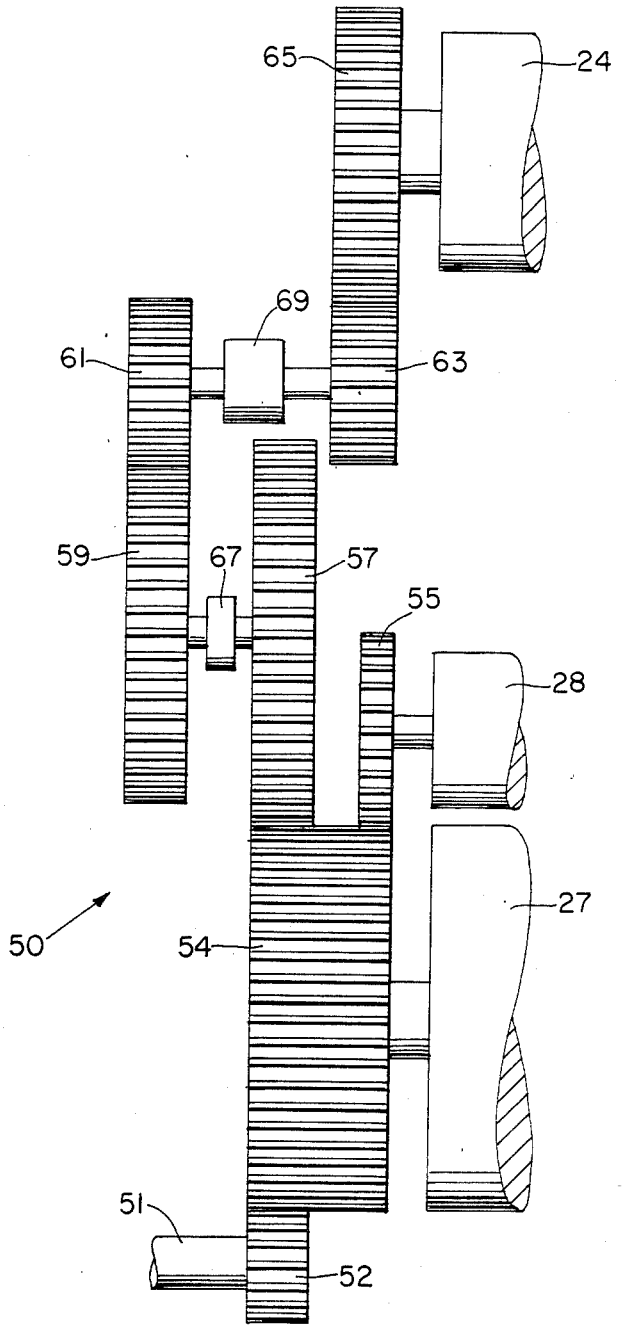
FIG. 2 is a fragmentary, somewhat schematic front elevational view of the drive means for the sheet count and length components of the improved paper rewinder of FIG. 1.
Figure 3:
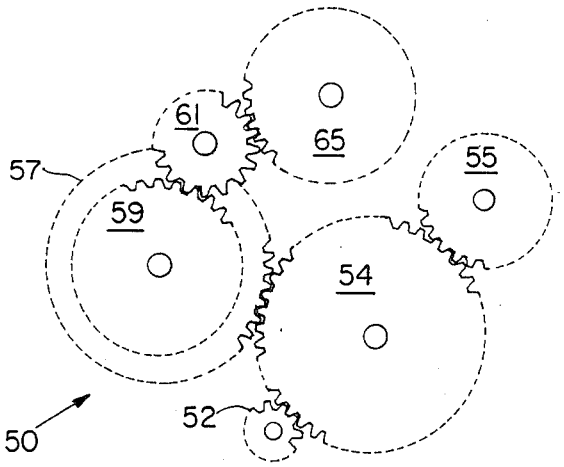
FIG. 3 is a fragmentary side elevational view of the drive means shown in FIG. 2.

Sheet count changes may best be described by referring to the gear train drives for the perforator cylinder 24, the bedroll 27, and the chopper roll 28 as shown in FIGS. 2 and 3; and then describing what is done to achieve a sheet count change.

In an exemplary embodiment of the present invention which, when set up for a sheet count per product roll of ninety-two (92) sheets, and having a nominally four (4) sheet per revolution bedroll, the several gears of the gear train shown in FIGS. 2 and 3 have the following tooth counts: gear 54, one-hundred (100) teeth; gear 55, fifty (50) teeth; gears 57 and 59, ninety-two (92) teeth each; gears 62 and 63, forty (40) teeth each; and gear 65, seventy-five (75) teeth. Thus, for each ninety-two sheet product roll 30, FIG. 1, the bedroll 27 rotates twenty-three (23) revolutions; and the perforator cylinder rotates thirty-and-two-thirds (30 $\frac{2}{3}$) revolutions. The Chopper roll 28 is geared to turn two (2) revolutions per revolution of the bedroll. The method of computing the gear changes required to effect different sheet counts is delineated below. However, suffice it to say that the following tabulation of sheet counts can be provided by the gear sets set forth in the tabulation for a tensioned sheet length of eleven-and-one-quarter (11.25) inches (about 28.6 cm.) using a bedroll 27 having a circumference of forty-five (45) inches (about 114.3 cm.).

| SHEET COUNT | TEETH, BEDROLL CHANGE GEAR 57 | TEETH, PERFORATOR ROLL CHANGE GEAR 59 |
|---|---|---|
| 85 | 84 | 85 |
| 86 | 88 | 86 |
| 87 | 88 | 87 |
| 88 | 88 | 88 |
| 89 | 88 | 89 |
| 90 | 92 | 90 |
| 91 | 92 | 91 |
| 92 | 92 | 92 |
| 93 | 92 | 93 |
| 94 | 96 | 94 |
| 95 | 96 | 95 |

The general method of computing the number of teeth for gears 57 and 59 for particular sheet counts is:

a. Gear 59: The number of teeth on gear 59 is exactly equal to the sheet count. For example, gear 59 has one hundred (100) teeth for a sheet count of one hundred (100), ninety (90) teeth for a sheet count of ninety (90), etc.

b. Gear 57: The number of teeth on gear 57 is exactly equal to the number of bedroll revolutions per product roll multiplied by four (4): i.e., the nominal number of sheets per bedroll circumference. The number of bedroll revolutions per product roll is the closest integer to: sheet count multiplied by nominal sheet length divided by bedroll circumference. For example, the number of bedroll revolutions for a sheet count of ninety-five (95) and a sheet length of eleven-and-one-quarter (11.25) inches (about 28.6 cm.) is equal to $95 \times 11.25/45 = 23.75$. Rounding to the nearest integer yields twenty-four (24) bedroll revolutions per product roll. The number of teeth on gear 57 is then twenty-four (24) times four (4) which is ninety-six (96).

An exemplary phase adjustor 48, FIG. 1, for a modified PCMC Series 150 rewinder as described herein is Model DL.0.254-6:7 ratio which is manufactured by Andantex Incorporated, U.S.A. Wanamassa, N.J.

Referring back to FIG. 2, coupler 67 and the coupler portion of coupler/phase adjustor 69 are provided to compensate for the center to center variations which are incurred due to gear changes. Exemplary couplers for this purpose are Schmidt couplings, Model L375C/F, available from Zero Max, Minneapolis, Minn. Also, in FIG. 2, the input drive shaft 51 to the gear train assembly 50 is provided with drive pinion 52.

Figure 4:
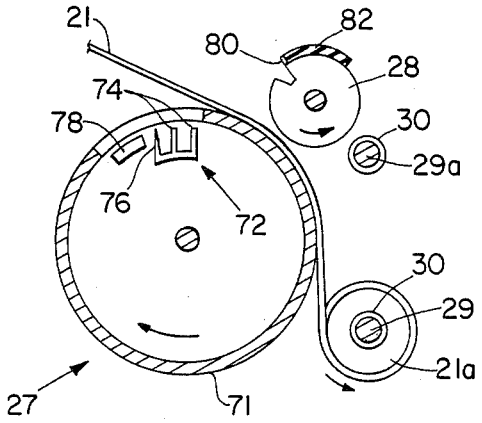
FIG. 4 is an enlarged scale, somewhat schematic fragmentary side elevational view of the bedroll, chopper roll, and portions of the rewind turret of the improved paper rewinder shown in FIG. 1.

Turning now to FIG. 4, some of the features of bedroll 27 and chopper roll 28, and their relationships with the rewinder's turret which carries plural mandrels (eg., six (6) mandrels on the turret on Series 150 Rewinders marketed by Paper Converting Machine Co.) are described in order to understand the overall operation of improved rewinders which embody the present invention.

Bedroll 27, FIG. 4, comprises a shell 71, plural radially moveable members 72 having radially outwardly extending fences 74 and pins 76, and radially moveable booties 78. Except for roll end/begin events, these radially moveable members are disposed in their retracted positions below the surface of shell 71. During roll end/begin events they are extended through a cross machine direction oriented array of slots in shell 71 for the purposes described below.

Chopper roll 28 has a radially outwardly extending blade 80 and a cushion 82. It is indexed through the above described gear train so that blade 80 will extend into the space between the fences 74 when they are extended during roll end/begin events.

Briefly, during a roll end/begin event, members 72 are extended and raise the path of the paper web from the surface of shell 71 to drape across the distal tips of fences 74. At the same time, pins 76 impale the web of paper adjacent the closest fence 74. As the bedroll 27 and chopper roll 28 rotate to move the blade 80 between fences 74, the paper web 21 is broken along a line of perforations due to its resistance to having its path length increased between fences 74 by the blade 80 descending therebetween. Referring back to FIGS. 1, and 2, the phase adjusting means 48, FIG. 1, which schematically is included in coupler/phase adjuster 69, FIG. 2, is provided to angularly phase the perforator cylinder 24 with the bedroll 27 so that lines of perforation do in fact fall between fences 74 during roll end/begin events.

Still referring to FIG. 4, **21*a* indicates a roll of paper 21 on core 30; and 29*a* indicates a second mandrel on the turret which mandrel 29*a* has a core 30 disposed thereon. Thus, mandrel 29*a* is ready to be indexed to the position where the leading edge of the next roll of paper will be afixed to core 30, and then indexed on down to where mandrel is positioned to complete winding the roll 21*a*. At other turret positions not shown, completed rolls 21*a*** are stripped from their mandrels, and empty cores are placed on the mandrels to continue the machine cycle.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In an improved paper converting rewinder of the type which includes means for continuously unwinding successive parent rolls of paper and forwarding the paper through the rewinder, means including a perforator cylinder for providing transverse lines of perforations across the paper at product sheet length intervals in the machine direction to define product sheets of the paper, means including a bedroll and a chopper roll having means for breaking the paper along lines of the perforations which lines are product roll length spaced in the machine direction to define product roll lengths of the paper consisting of a predetermined count of the product sheets, means for initiating such breaking of the paper each time said bedroll completes a predetermined number of whole revolutions, and means for winding each product roll length of the paper on a tubular core to thereby make successive product rolls of the paper, the improvement comprising means for adjusting sheet length and means for effecting integer changes in sheet count per said product roll without changing either the perforation cylinder or the bedroll, said means for adjusting sheet length and a sheet count comprising means for independently controlling the velocity of said paper relative to the surface velocities of said perforator cylinder and said bedroll, and for enabling said paper to slip relative to the surfaces of said perforator cylinder and said bedroll.

2. The improved paper converting rewinder of claim 1 wherein said means for effecting integer changes in sheet count comprises means for effecting stepwise gear drive ratio changes between said perforator cylinder and said bedroll.

3. The improved paper converting rewinder of claim 1 which further includes a stationary anvil that is helically configured and disposed with respect to a cross machine direction oriented perforating blade on the perforator cylinder to provide true cross machine direction oriented lines of perforation when the velocity of the paper is equal to the surface velocity of the perforating cylinder, said improvement further comprising a frame in which the perforator cylinder and said anvil are mounted, and means for adjusting the skew angle of said frame sufficiently with respect to the paper to provide true cross machine direction orientation of the lines of perforation when the velocity of the paper is not equal to the surface velocity of the perforator cylinder.

4. The improved paper converting rewinder of claim 1, 2 or 3 further comprising dynamic angular phase adjusting means intermediate the perforator cylinder and the bedroll for enabling aligning each line of perforation to be broken by the means for breaking disposed on the bedroll as the paper is being forwarded through said rewinder.

* * * * *